US006277241B1

(12) United States Patent
Merker et al.

(10) Patent No.: US 6,277,241 B1
(45) **Date of Patent: *Aug. 21, 2001**

(54) LIQUID ABSORBENT BASE WEB

(75) Inventors: Joseph F. Merker, Alpharetta; Ralph L. Anderson, Marietta; Thomas C. Saffel, Alpharetta; Stephen A. Hurst, Atlanta, all of GA (US); Charles J. Garneski, Bothell; Gary L. Zimmerman, Marysville, both of WA (US)

(73) Assignee: Kimberly-Clark Worldwide, Inc., Rosewell, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/971,211

(22) Filed: Nov. 14, 1997

(51) Int. Cl.[7] ..... D21H 13/00

(52) U.S. Cl. ..... 162/111; 162/112; 162/125; 162/127; 162/129; 162/130; 162/134; 162/135; 162/146

(58) Field of Search ..... 162/111, 112, 162/113, 125, 127, 129, 130, 134, 135, 146

(56) References Cited

U.S. PATENT DOCUMENTS

| | | | | |
|---|---|---|---|---|
| 3,778,341 | * | 12/1973 | Plummer et al. | 162/146 |
| 3,879,257 | * | 4/1975 | Gentile et al. | 162/112 |
| 3,903,342 | * | 9/1975 | Roberts, Jr. | 162/112 |
| 4,158,594 | * | 6/1979 | Becker et al. | 162/112 |
| 4,166,001 | * | 8/1979 | Dunning et al. | 162/113 |
| 4,429,014 | * | 1/1984 | Isner et al. | 428/152 |
| 4,913,773 | * | 4/1990 | Knudsen et al. | 162/129 |
| 5,102,501 | * | 4/1992 | Eber et al. | 162/129 |
| 5,147,505 | * | 9/1992 | Altman | 162/129 |
| 5,164,045 | * | 11/1992 | Awofeso et al. | 162/101 |
| 5,437,908 | * | 8/1995 | Demura et al. | 428/154 |
| 5,674,590 | * | 10/1997 | Anderson et al. | 428/154 |
| 5,776,306 | * | 7/1998 | Hepford | 162/112 |

* cited by examiner

*Primary Examiner*—Peter Chin
(74) *Attorney, Agent, or Firm*—Dority & Manning, P.A.

(57) ABSTRACT

The present invention is generally directed to base webs that are creped after a bonding material has been applied to at least one side of the web according to a predetermined pattern. The base web disclosed in the present application is made from at least three fibrous layers. The outer layers of the web contain synthetic staple fibers for increasing the tensile strength and abrasion resistant properties of the web. In one embodiment, the middle layer can further contain hardwood fibers, such as eucalyptus fibers, which improves the wipe dry properties of the web.

33 Claims, 3 Drawing Sheets

LIQUID ABSORBENT BASE WEB

FIELD OF THE INVENTION

The present invention is generally directed to abrasion resistant and strong base webs that have good liquid absorption properties. The base web is generally made from a combination of pulp fibers and synthetic fibers. In one embodiment, the base web is used as a wiping product.

BACKGROUND OF THE INVENTION

Liquid absorbent products such a paper towels, industrial wipers, food service wipers, napkins, medical pads, and other similar products are designed to include several important properties. For example, the products should have good bulk, a soft feel and should be highly absorbent. The products should also have good strength even when wet and should resist tearing. Further, the products should also have good stretch characteristics, should be abrasion resistant, and should not deteriorate in the environment in which they are used.

In the past, many attempts have been made to enhance and increase certain physical properties of such products. Unfortunately, however, when steps are taken to increase one property of these products, other characteristics of the products may be adversely affected. For instance, the softness of paper wiping products can be increased by several different methods, such as by selecting a particular fiber type, or by reducing cellulosic fiber bonding within the product. Increasing softness according to one of the above methods, however, may adversely affect the strength of the product. Conversely, steps normally taken to increase the strength of a fibrous web typically have an adverse impact upon the softness or the absorbency of the web.

One particular process that has proven to be very successful in producing paper towels and other wiping products is disclosed in U.S. Pat. No. 3,879,257 to Gentile, et al., which is incorporated herein by reference in its entirety. In Gentile, et al., a process is disclosed for producing soft, absorbent, single ply fibrous webs having a laminate-like structure that are particularly well suited for use as wiping products.

The fibrous webs disclosed in Gentile, et al. are formed from an aqueous slurry of principally lignocellulosic fibers under conditions which reduce inner fiber bonding. A bonding material, such as a latex elastomeric composition, is applied to a first surface of the web in a spaced-apart pattern. In particular, the bonding material is applied so that it covers from about 50% to about 60% of the surface area of the web. The bonding material provides strength to the web and abrasion resistance to the surface. Once applied, the bonding material can penetrate the web preferably from about 10% to about 40% of the thickness of the web.

The bonding material can then be similarly applied to the opposite side of the web for further providing additional strength and abrasion resistance. Once the bonding material is applied to the second side of the web, the web can be brought into contact with a creping surface. Specifically, the web will adhere to the creping surface according to the pattern to which the bonding material was applied. The web is then creped from the creping surface with a doctor blade. Creping the web greatly disrupts the fibers within the web, thereby increasing the softness, absorbency, and bulk of the web.

In one of the preferred embodiments disclosed in Gentile, et al., both sides of the paper web are creped after the bonding material has been applied. Gentile, et al. also discusses the use of chemical debonders to treat the fibers prior to forming the web in order to further reduce innerfiber bonding and to increase softness and bulk.

Although the processes disclosed in Gentile, et al. have provided great advancements in the art of making disposable wiping products, the present invention is directed to further improvements in fibrous base webs. In particular, the present invention is directed to a fibrous base web having an improved combination of abrasion resistance, strength, and wipe dry properties. These and other advantages will be made apparent from the following description.

SUMMARY OF THE INVENTION

As stated above, the present invention is directed to further improvements in prior art constructions and methods, which are achieved by providing an abrasion resistant, liquid absorbent base web. The base web may include a first outer fibrous layer defining a first side of the web and a second and opposing outer fibrous layer defining a second side of the web. The first and second outer layers may contain synthetic staple fibers either alone or in combination with pulp fibers. An intermediate fibrous layer may be positioned between the first outer layer and the second outer layer. The intermediate layer may contain pulp fibers.

Desirably, a bonding material is applied to at least one side of the base web. In particular, the bonding material may be applied to the web according to a predetermined pattern, such as a geometric pattern. After the bonding material is applied to at least one side of the web, the web may be creped. For instance, in one embodiment, the bonding material may be applied to both sides of the base web and both sides of the web may then be creped.

The synthetic staple fibers contained within the base web of the present invention can be made from one or more polymers including polyester, nylon, polypropylene and rayon. The fibers can have a length of at least 0.25 inches and can have a denier of less than about 2.5, and particularly less than 1.5. The synthetic fibers can be added to the base web in an/amount up to about 50% by weight and particularly from about 5% to about 15% by weight. Further, each outer layer containing the synthetic fibers can comprise from about 15% to about 40% of the total weight of the web, and particularly from about 25% to about 35% of the weight of the web.

In order to increase softness and the liquid absorbent properties of the base web, the intermediate fibrous layer can contain short pulp fibers having a low coarseness, which create a pore size gradient between the outer layers and the inner layer. It is believed that by creating a pore size gradient, the base web has improved wicking properties. Short fibers having a low coarseness that may be included in the intermediate layer include hardwood fibers, such as eucalyptus fibers or eucalyptus-like fibers. For instance, the fibers can have a length of less than about 2.0 millimeters and a coarseness of less than about 10. The hardwood fibers can be present within the base web in an amount from about 10% to about 40% by weight.

Other fibers that may be incorporated into the intermediate fibrous layer in order to improve the wipe dry properties of the base web include highly liquid absorbent and highly wettable fibers. For instance, such fibers can include highly extracted pulp fibers, such as mercerized alpha pulp fibers. The alpha pulp can be made from softwood fibers or hardwood fibers and can be present in the intermediate layer either alone or in combination with the above-described fibers.

The bonding material applied to the base web can be applied in a pattern that covers from about 10% to about 60%, and more particularly from about 20% to about 50% of the surface area of each side of the web. The bonding material can be applied to each side of the web in an amount up to about 10% by weight, and particularly from about 5% to about 8% by weight. Once applied, the bonding material can penetrate the web in an amount from about 15% to about 50% of the total thickness of the web.

The preselected pattern used to apply the bonding material can be, in one embodiment, a reticular interconnected design. Alternatively, the preselected pattern can comprise a succession of discrete dots. The bonding material can be for instance, a latex, such as an ethylene vinyl acetate copolymer cross-linked with N-methyl acrylamide groups. Copolymers of vinyl acrylics with cross-linking capability are also useful.

Once formed, the base web of the present invention can have a basis weight of from about 20 pounds per ream to about 80 pounds per ream, depending upon the particular application. The base web can be used in numerous products. For instance, the base web can be used as a wiping product, as a napkin, as a medical pad, as a placemat, as a cover material such as a car cover, as a paint drop cloth, as one layer in a laminate product or as any other similar liquid absorbent product.

These and other features are also achieved by providing a method for producing a base web. The method may include first providing a fibrous web having a middle layer containing pulp fibers, such as hardwood fibers. The base web may further include a first outer layer containing synthetic staple fibers and a second outer layer also containing synthetic staple fibers. The synthetic staple fibers may be present within the outer layers either alone or in combination with pulp fibers.

A first bonding material may be applied to the first side of the web in a preselected pattern and, if desired, a second bonding material may be applied to the second side of the web also in a preselected pattern. Once the bonding materials are applied to the web, the web may then be creped. For instance, the web can be adhered to a creping surface and then creped from the surface using, for instance, a creping blade.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
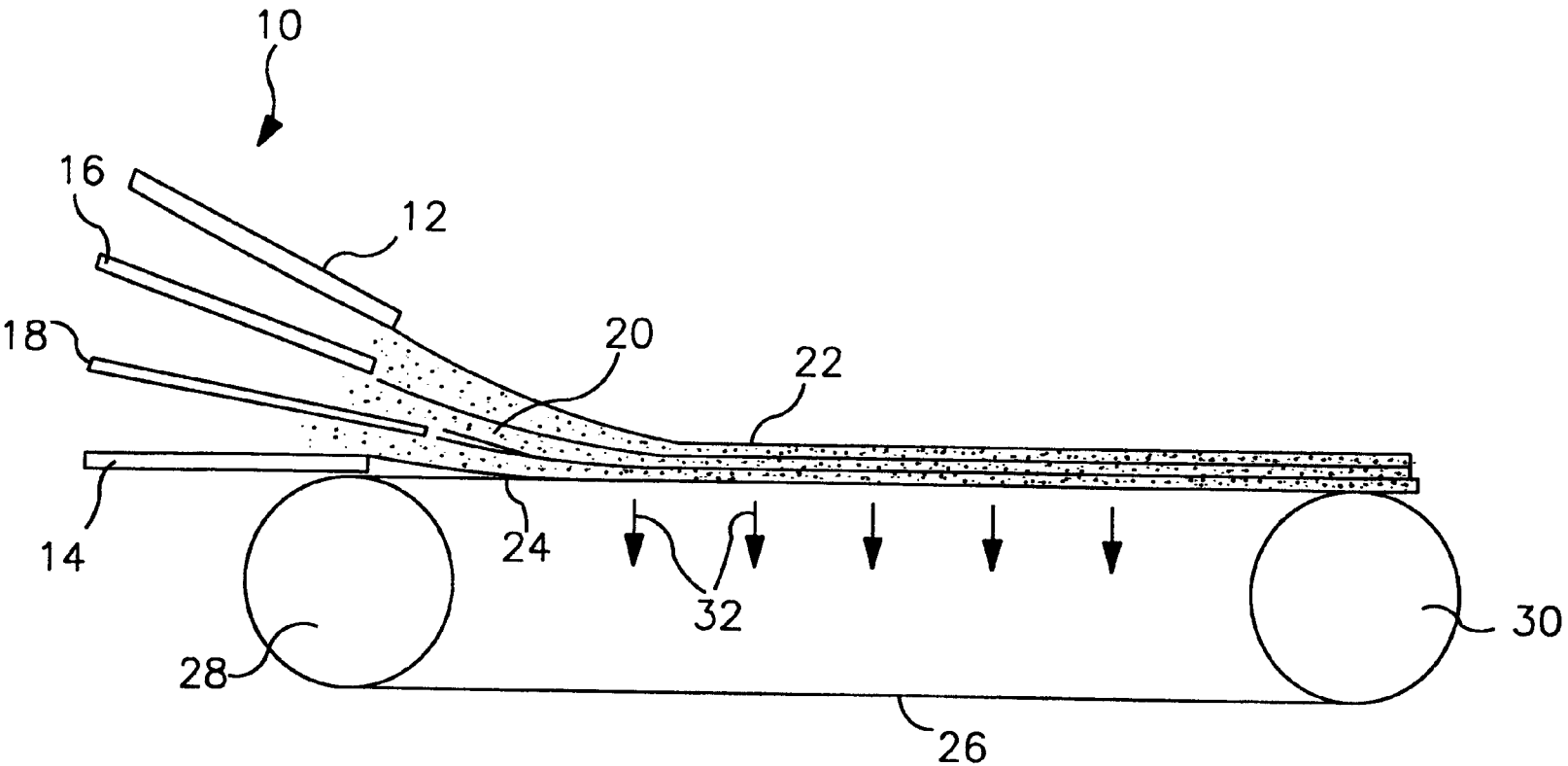
FIG. 1 is a schematic diagram of a fibrous web forming machine illustrating one embodiment for forming a base web having multiple layers in accordance with the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a strong and abrasion resistant base web. Of particular advantage, in one embodiment, the base web is made with improved strength while maintaining good softness characteristics and liquid absorbency properties. In particular, the base web contains an extremely efficient wicking mechanism which transports fluid from the surface of the base web into the interior of the web. Further, the base web has good stretch characteristics, is tear-resistant and does not produce a substantial amount of lint when in use.

The base web of the present invention may have a multi-layer construction. In particular, the web may be made from a stratified fiber furnish having three principal layers. In accordance with the present invention, the outer layers of the web contain staple synthetic fibers, such as polymeric fibers. The synthetic fibers in the outer layers of the web make the web resistant to surface abrasion and reinforce the tensile strength properties of the web.

In one embodiment, the base web can also include an intermediate layer containing relatively short fibers that have a low coarseness value or other highly wettable and absorbent fibers. For instance, the intermediate layer can contain hardwood fibers, such as eucalyptus fibers or eucalyptus-like fibers. The hardwood fibers contained within the intermediate layer create a pore and capillary size gradient between the outer layers and the intermediate layer. This pore and capillary size gradient increases the wicking properties of the base web, providing the web with enhanced liquid absorbent properties. The intermediate layer of the web counteracts the hydrophobicity of the synthetic fibers causing fluids contacting the web to be transported into the interior of the web. Further, since the hardwood fibers are contained in the intermediate layer, the base web does not create a substantial amount of lint when in use.

The base web of the present invention may further include a bonding material that is applied to at least one side of the web, and desirably to both sides of the web. After the bonding material is applied, the web may be creped at least on one side and preferably on both sides. More particularly, the bonding material may be applied to the web in a preselected pattern for providing strength and stretchability without adversely affecting the softness of the web. Creping the web increases the softness and bulk of the web.

As stated above, one aspect of the present invention is directed to incorporating into the outer layers of the base web synthetic staple fibers. As used herein, synthetic staple fibers refer to fibers made from one or more synthetic materials, such as polymeric materials, and can include single component and multi-component fibers, such as bicomponent fibers. Bicomponent fibers refer to fibers made from two distinct polymers such as in a side-by-side arrangement or in a core and sheath arrangement. Particular materials which may be used to construct the synthetic fibers include nylon, polypropylene, and rayon. In one preferred embodiment, polyester fibers are used.

In general, the length and the denier of the synthetic fibers will depend upon the particular application and the manner in which the base web is formed. For most applications, the fibers should have a length of at least 0.25 inches, such as from about 0.25 inches to about 0.75 inches. Longer fibers, which may enhance the strength of the web, however, may be used.

The denier of the fibers, on the other hand, is preferably relatively low. For instance, the denier of the fibers can be less than about 2.5 dpf, and particularly less than about 1.5 dpf. By using smaller denier fibers, less material may be needed in forming the web.

The synthetic staple fibers should be incorporated into the outer layers of the web in an amount sufficient to increase the abrasion resistance and the tensile strength properties of the web. The amount of synthetic fibers added to the web will also generally depend upon the particular application. In most embodiments, the synthetic fibers can be present within the web in an amount up to about 50% by weight, and particularly from about 5% to about 15% by weight. Further, for most applications, the amount of synthetic fibers contained within one of the outer layers of the base web will be substantially equal to the amount of synthetic fibers contained within the opposing outer layer of the base web.

The weight of each outer layer in relation to the total weight of the web is generally not critical. In most embodiments, however, the weight of each outer layer will be from about 15% to about 40% of the total weight of the web, and particularly from about 25% to about 35% of the weight of the web.

Besides synthetic staple fibers, the outer layers can also contain pulp fibers, such as various cellulosic fibers. For example, in one embodiment, Northern softwood kraft fibers can be combined with the synthetic fibers. Softwood fibers generally have a fiber length of from about 1.8 millimeters to about 3 millimeters. Preferably, the pulp fibers are mixed homogeneously with the synthetic staple fibers.

The middle layer of the base web of the present invention can contain various types of fibers. In one preferred embodiment, the middle layer contains hardwood fibers either alone or in combination with softwood fibers. In particular, hardwood fibers can be added to the middle layer so as to create a pore and capillary size gradient between the outer layers and the middle layer, which creates a highly efficient wicking mechanism as described above.

More particularly, the hardwood fibers incorporated into the middle layer of the base web should have a relatively short fiber length and a relatively low coarseness rating, which serve to create the pore size gradient described above. For instance, the hardwood fibers can have a length of less than about 2 millimeters, and particularly less than about 1.5 millimeters. The coarseness rating of the fibers, on the other hand, can be less than 10, and particularly less than 8, as determined on a KAJANNI fiber testing machine.

In one embodiment, the hardwood fibers incorporated into the middle layer of the base web include eucalyptus fibers. Eucalyptus fibers typically have a length of from about 0.8 millimeters to about 1.2 millimeters. When added to the web, eucalyptus fibers increase the softness, enhance the brightness, increase the opacity, and increase the wicking ability of the web.

Besides eucalyptus fibers, other eucalyptus-like fibers may also be incorporated into the base web of the present invention. As used herein, eucalyptus-like fibers refer to fibers that have similar characteristics to eucalyptus fibers. Such fibers include, for instance, birch fibers and possibly recycled wood fibers.

Besides the above-described hardwood fibers, other fibers particularly well-suited for use in the middle layer of the base web are highly absorbent and wettable fibers, such as those produced when wood pulp is highly extracted. For instance, mercerized alpha pulp may be incorporated into the base web. Alpha pulp can contain softwood fibers or hardwood fibers. Since alpha pulp is highly wettable, the pulp will increase the wipe dry properties of the base web similar to eucalyptus fibers. Alpha pulp is commercially available from, for instance, IT Rayonier.

In general, the above-described hardwood fibers or alpha pulp can be present in the base web in an amount from about 10% to about 40% by weight and particularly in an amount of about 20% by weight. The fibers can comprise from about 5% to about 100% by weight of the middle layer of the web.

As stated above, the hardwood fibers or alpha pulp fibers can be present within the middle layer of the web either alone or in combination with other fibers, such as other cellulosic fibers. For instance, the hardwood fibers can be combined with softwood fibers, with recycled fibers, with superabsorbent materials, and with thermomechanical pulp. Besides fibers, any material that may enhance a property of the base web may also be included within the middle layer.

The multi-layered base web made according to the process of the present invention, for most applications, should be formed without a substantial amount of inner fiber-to-fiber bond strength. In this regard, the fiber furnish used to form the base web can be treated with a chemical debonding agent. The debonding agent can be added to the fiber slurry during the pulping process or can be added directly into the head box. Suitable debonding agents that may be used in the present invention include cationic debonding agents such as fatty dialkyl quaternary amine salts, mono fatty alkyl tertiary amine salts, primary amine salts, imidazoline quaternary salts, and unsaturated fatty alkyl amine salts. Other suitable debonding agents are disclosed in U.S. Pat. No. 5,529,665 to Kaun which is incorporated herein by reference.

In one pre,ferred embodiment, the debonding agent used in the process of the present invention can be an organic quaternary ammonium chloride. In this embodiment, the debonding agent can be added to the fiber slurry in an amount from about 0.1% to about 1% by weight, based on the total weight of fibers present within the slurry.

The manner in which the base web of the present invention is formed may vary depending upon the particular application. For instance, in one embodiment, the web can be formed in a wet lay process according to conventional paper making techniques. In a wet lay process, the fiber furnish is combined with water to form an aqueous suspension. The aqueous suspension is spread onto a wire or felt and dried to form the web.

Alternatively, the base web of the present invention can be air formed. In this embodiment, air is used to transport the fibers and form a web. Air forming processes are typically capable of processing longer fibers than most wet lay processes, which may provide an advantage in some applications.

Figure 2:
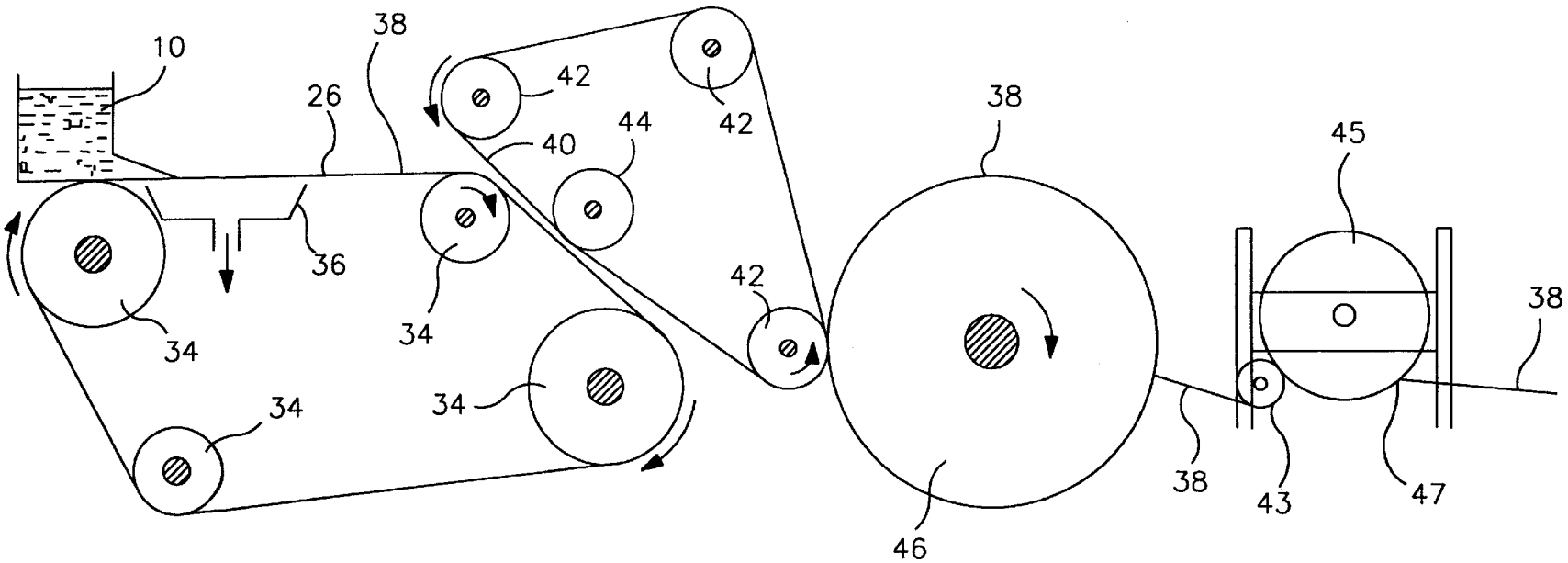
FIG. 2 is a schematic diagram of a fibrous web forming machine that crepes one side of the web.
Figure 3:
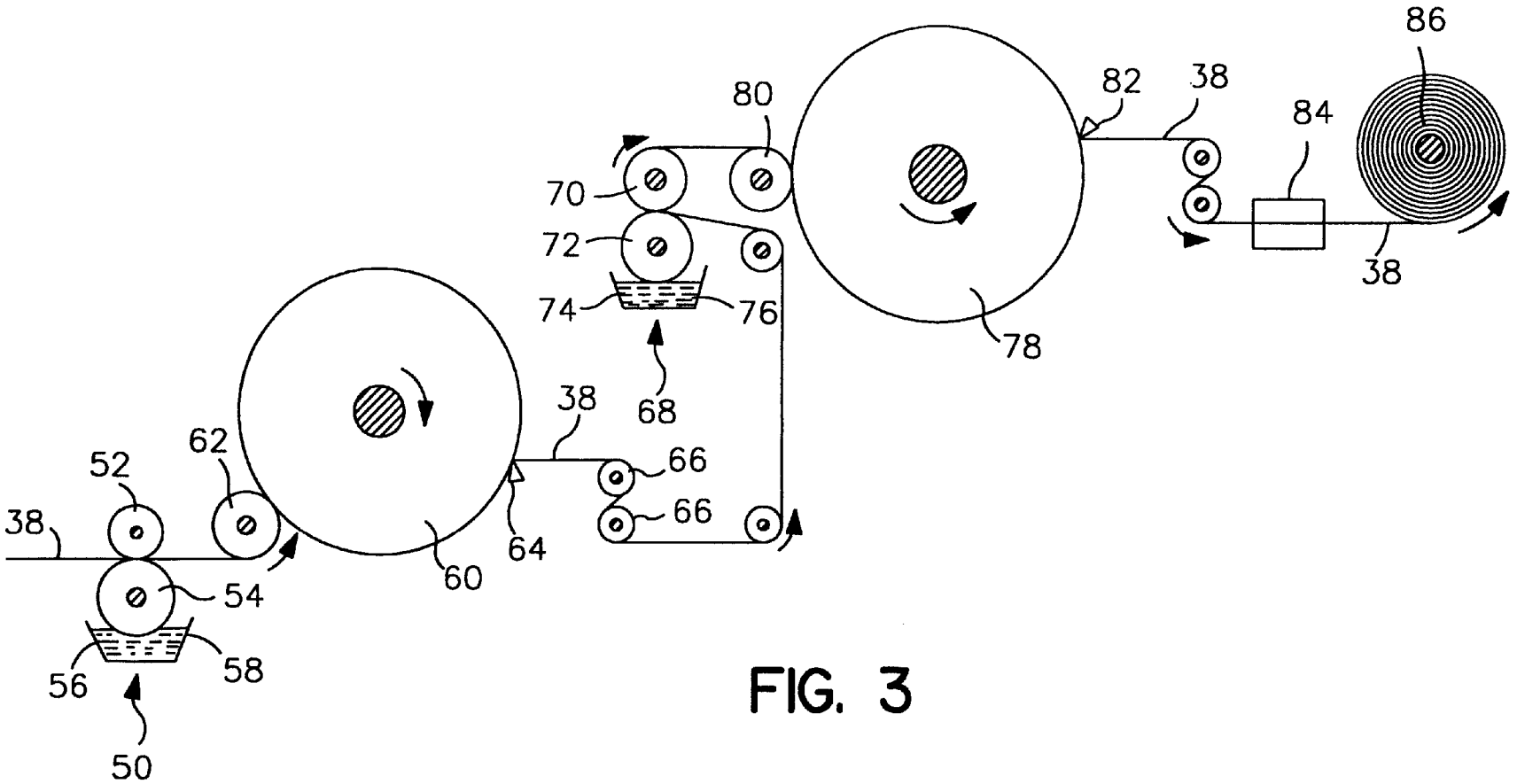
FIG. 3 is a schematic diagram of one embodiment of a system for double creping a base web in accordance with the present invention.

Referring to FIGS. 1–3, one embodiment of a process for producing a base web in accordance with the present invention is illustrated. The process illustrated in the figures depicts a wet lay process, although, as described above, other techniques for forming the base web of the present invention may be used.

Referring to FIG. 1, one embodiment of a device for forming a multi-layered stratified fiber furnish is illustrated. As shown, a three-layered head box generally 10 may include an upper head box wall 12 and a lower head box wall 14. Head box 10 may further include a first divider 16 and a second divider 18, which separate three fiber stock layers.

Each of the fiber layers comprise a dilute aqueous suspension of fibers. In accordance with the present invention, as described above, middle layer 20 can contain hardwood fibers, softwood fibers or a combination of both. Outer layers 22 and 24, on the other hand, contain synthetic staple fibers alone or in combination with pulp fibers, such as softwood fibers.

An endless traveling forming fabric 26, suitably supported and driven by rolls 28 and 30, receives the layered stock issuing from head box 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered webs is also described and disclosed in U.S. Pat. No. 5,129,988 to Farrington, Jr. and in U.S. Pat. No. 5,494,554 to Edwards, et al., which are both incorporated herein by reference.

Referring to FIG. 2, one embodiment of a base web forming machine is illustrated capable of receiving the layered fiber suspension from head box 10 and forming a web. As shown, in this embodiment, forming fabric 26 is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. Preferably, the speed at which fabric 40 is driven is approximately the same speed at which fabric 26 is driven so that movement of web 38 through the system is consistent.

From fabric 40, web 38, in this embodiment, is transferred to the surface of a rotatable heated dryer drum 46, such as a Yankee dryer. Web 38 is lightly pressed into engagement with the surface of dryer drum 46 to which it adheres, due to its moisture content and its preference for the smoother of the two surfaces. As web 38 is carried through a portion of the rotational path of the dryer surface, heat is imparted to the web causing most of the moisture contained within the web to be evaporated.

In an alternative embodiment, web 38 can be through dried instead of being placed on a dryer drum. A through dryer accomplishes the removal of moisture from the web by passing air through the web without applying any mechanical pressure. Through drying can increase the bulk and softness of the web.

From drier drum 46, as shown in FIG. 2, web 38 is pressed into engagement with a creping drier 45 by a press roll 43. Press roll 43 in combination with creping drier 45 apply a sufficient amount of heat and pressure to web 38 for causing the web to adhere to the creping drier surface without the use of an adhesive. An adhesive, however, if desired may be applied over the surface of the web or drum for facilitating attachment of the web to the drum.

Web 38 is then removed from drier drum 45 by a is creping blade 47. Creping web 38 as it is formed reduces internal bonding within the web and increases softness.

The base web formed from the process illustrated in FIG. 2, possesses certain physical characteristics that are particularly advantageous for use in the remainder of the process of the present invention. In particular, web 38 is characterized by having a reduced amount of inner fiber bonding strength. As described above, the web can also contain hardwood fibers. Low bonding strength in combination with hardwood fibers provides softness, bulk, absorbency, opacity, wicking ability and brightness. As will be described hereinafter, the remainder of the process of the present invention is designed not only to enhance the above properties but also to provide the paper web with strength and stretchability.

Once paper web 38 is formed, a bonding material may be applied to at least one side of the web and at least one side of the web may then be creped. For most applications, desirably a bonding material is applied to both sides of the web and both sides of the web are creped. When the base web of the present invention is used in a multi-ply laminate, however, it may be desired to only apply the bonding material to one side of the web. For instance, when making a two-ply product, two base webs made according to the present invention may be brought together and joined along adjacent surfaces where the bonding material has not been applied.

Referring to FIG. 3, a process for applying a bonding material to both sides of the web and to creping both sides of the web in accordance with the present invention is illustrated. As shown, desirably, base web 38 made according to the process illustrated in FIG. 2 or according to a similar process, is passed through a first bonding material application station generally 50. Station 50 may include a nip formed by a smooth rubber press roll 52 and a patterned rotogravure roll 54. Rotogravure roll 54 may be in communication with a reservoir 56 containing a first bonding material 58. Rotogravure roll 54 applies bonding material 58 to one side of web 38 in a preselected pattern.

Web 38 is then pressed into contact with a first creping drum 60 by a press roll 62. The bonding material causes only those portions of the web where it has been disposed to adhere to the creping surface. If desired, creping drum 60 can be heated for promoting attachment between the web and the surface of the drum and for partially drying the web.

Once adhered to creping drum 60, web 38 may be brought into contact with a creping blade 64. Specifically, web 38 may be removed from creping roll 60 by the action of creping blade 64, performing a first controlled pattern crepe on the web.

Once creped, web 38 can be advanced by pull rolls 66 to a second bonding material application station generally 68. Station 68 may include a transfer roll 70 in contact with a rotogravure roll 72, which may be in communication with a reservoir 74 containing a second bonding material 76. Similar to station 50, second bonding material 76 may be applied to the opposite side of web 38 in a preselected pattern. Once the second bonding material is applied, web 38 may be adhered to a second creping roll 78 by a press roll 80. Desirably, web 38 is carried on the surface of creping drum 78 for a distance and then removed therefrom by the action of a second creping blade 82. Second creping blade 82 performs a second controlled pattern creping operation on the second side of the base web.

Once creped for a second time, base web 38, in this embodiment, is pulled through a curing or drying station 84. Drying station 84 can include any form of a heating unit, such as an oven energized by infrared heat, microwave energy, hot air or the like. Drying station 84 may be necessary in some applications to dry the web and/or cure the first and second bonding materials. Depending upon the bonding materials selected, however, in other applications drying station 84 may not be needed.

Once drawn through drying station 84, web 38 can be wound into a roll of material 86 for immediate use of for further processing according to the present invention.

The bonding materials applied to each side of base web 38 are selected for not only assisting in creping the web but also for adding dry strength, wet strength, stretchability, and tear resistance to the web. The bonding materials also prevent lint from escaping from the web during use.

The bonding material may be applied to the base web as described above in a preselected pattern. In one embodiment, for instance, the bonding agent can be applied to the web in a reticular pattern, such that the pattern is interconnected forming a net-like design on the surface.

In an alternative embodiment, the bonding material can be applied to the web in a pattern that represents a succession of dots or other geometric shapes. Applying the bonding material in discrete shapes, such as dots, provides strength to the web without covering a substantial portion of the surface area of the web.

In general, according to the present invention, the bonding material may be applied to each side of the base web so as to cover from about 10% to about 60% of the surface area of the web. More particularly, in most applications, the bonding material will cover from about 20% to about 50% of the surface area of each side of the web. The amount of bonding material applied to each side of the web will desirably be in the range of from about 3% to about 10% by weight and particularly from about 6% to 8% by weight, based upon the total weight of the web. For instance, in one embodiment, the bonding material can be applied to each side of the web in an amount of about 7% by weight.

At the above amounts, the bonding material can penetrate the base web from about 25% to about 50% of the total thickness of the web. In most applications, the bonding material should at least penetrate from about 10% to about 15% of the thickness of the web.

Particular bonding materials that may be used in the present invention include latex compositions, such as acrylates, vinyl acetates, vinyl chlorides, and methacrylates. Some water soluble bonding materials may also be used including polyacrylamides, polyvinyl alcohols, and carboxymethyl cellulose.

In one preferred embodiment, the bonding material used in the process of the present invention comprises an ethylene vinyl acetate copolymer. In particular, the ethylene vinyl acetate copolymer is desirably cross-linked with N-methyl acrylamide groups using an acid catalyst. Suitable acid catalysts include ammonium chloride, citric acid, and maleic acid. The bonding material should have a glass transition temperature of not lower than −10° F. and not higher than +20° F.

Base webs made according to the above described process provide many advantages and benefits over conventional constructions. In particular, base webs made according to the present invention have enhanced abrasion resistant properties and tensile strength properties. In fact, it has been discovered that base webs made according to the present invention have a total tensile strength (cross direction plus machine direction strength) that is much higher at higher bulks than many prior art constructions. Further, when the base web of the present invention contains hardwood fibers or other highly wettable fibers as described above, the strength of the web is enhanced while at the same time creating a web with good wipe dry properties.

The basis weight of base webs made according to the present invention can vary depending upon the particular application. In general, for most applications, the basis weight can be from about 20 pounds per 2,880 square feet (ream) to about 80 pounds per ream. Some of the uses of the base webs include use as a wiping product, as a napkin, as a medical pad, as an absorbent layer in a laminate product, as a placemat, as a drop cloth, as a cover material, or for any product that requires liquid absorbency.

The present invention may be better understood with reference to the following example.

EXAMPLE

The following example was performed in order to compare a base web made according to the present invention with a base web that has been used in the past as a wiping product.

A base web made in accordance with the present invention was produced according to a process similar to the one illustrated in FIGS. 1–3. The base web contained a middle layer separated by two outer layers. In particular, each outer layer accounted for about 26% by weight of the web, while the middle layer accounted for about 47% of the weight of the web.

In accordance with the present invention, each outer layer contained polyester fibers. The polyester fibers were present within the web in an total amount of about 8% by weight (4% by weight in each outer layer). In this arrangement, the polyester fibers accounted for about 15% of the surface fibers. The remainder of the outer layers was comprised of pulp fibers, specifically softwood fibers.

The middle layer contained a mixture of softwood fibers and eucalyptus fibers. The eucalyptus fibers were present in the base web in an amount of 20% by weight, so as to account for about 42% by weight of the middle layer.

After the base web was formed, a bonding material was printed on each side of the web and both sides of the web were creped. The bonding material used was an ethylene vinyl acetate latex. The bonding material was applied to each side of the web according to a small diamond-shaped pattern. The bonding material was also applied to one side of the web according to a larger diamond-shaped pattern mostly to improve the aesthetic appearance of the base web.

In was noticed that the resulting base web had good handfeel and a good aesthetic appearance. Four samples of the base web were tested and the following results were obtained:

TABLE 2

Results of a Conventionally made Base Web Containing Polyester Fibers in the Middle Layer

| Sample | Basis Weight (lbs/ream) | Bulk | Machine Direction Tensile (oz/in) | Machine Direction Stretch (%) | Cross Direction Tensile (oz/in) | Cross Direction Stretch (%) | Cross Direction Wet Tensile (oz/in) |
|---|---|---|---|---|---|---|---|
| A | 45.8 | 39.03 | 51.6 | 31.2 | 46.7 | 15.8 | 29 |
| B | 46 | 38.16 | 52.7 | 28.8 | 44.1 | 14.4 | 29.5 |
| C | 46.8 | 39.73 | 56.2 | 29.1 | 45.7 | 15.1 | 29.1 |
| D | 46 | 37.96 | 53.2 | 30.04 | 46.5 | 15.6 | 28.3 |

TABLE 2-continued

Results of a Conventionally made Base Web Containing Polyester Fibers in the Middle Layer

| Sample | Basis Weight (lbs/ream) | Bulk | Machine Direction Tensile (oz/in) | Machine Direction Stretch (%) | Cross Direction Tensile (oz/in) | Cross Direction Stretch (%) | Cross Direction Wet Tensile (oz/in) |
|---|---|---|---|---|---|---|---|
| E | 46.8 | 39.03 | 61.9 | 31.8 | 46.5 | 15.8 | 30.1 |
| Average | 46.3 | 38.8 | 55.1 | 30.2 | 45.9 | 15.3 | 29.2 |

The above base web was compared to a conventionally made multi-layered base web containing polyester fibers in the middle layer. In the past, polyester fibers were incorporated into the middle layer of base webs in order to increase the strength of the webs.

The conventionally made base web included two outer layers made from softwood fibers and a middle layer containing a mixture of softwood fibers and polyester fibers. The polyester fibers were present within the middle layer in an amount of 15% by weight of the middle layer. Each layer of the web accounted for ⅓ of the total weight of the web.

Similar to the base web described above made according to the present invention, a bonding material was applied to each side of the conventionally made web and the web was creped on both sides.

Five samples of the conventionally made base web were tested and the results are as follows:

TABLE 2

Results of a Conventionally made Base Web Containing Polyester Fibers in the Middle Layer

| Sample | Basis Weight (lbs/ream) | Bulk | Machine Direction Tensile (oz/in) | Machine Direction Stretch (%) | Cross Direction Tensile (oz/in) | Cross Direction Stretch (%) | Cross Direction Wet Tensile (oz/in) |
|---|---|---|---|---|---|---|---|
| A | 45.8 | 39.03 | 51.6 | 31.2 | 46.7 | 15.8 | 29 |
| B | 46 | 38.16 | 52.7 | 28.8 | 44.1 | 14.4 | 29.5 |
| C | 46.8 | 39.73 | 56.2 | 29.1 | 45.7 | 15.1 | 29.1 |
| D | 46 | 37.96 | 53.2 | 30.04 | 46.5 | 15.6 | 28.3 |
| E | 46.8 | 39.03 | 61.9 | 31.8 | 46.5 | 15.8 | 30.1 |
| Average | 46.3 | 38.8 | 55.1 | 30.2 | 45.9 | 15.3 | 29.2 |

As shown above when comparing the two tables, the base web made according to the present invention had much better machine direction tensile strength and stretch properties than the conventionally made web. The total tensile strength of the base web made according to the present invention is also much greater in comparison to prior art constructions, especially at the bulk level that was tested. Further, although the cross direction strength and stretch properties were not as good as the conventionally made web, the base web of the present invention had better strength in the cross direction when wet. Further, because the base web of the present invention contains synthetic fibers on the outer layers, the web should have better abrasion resistant properties than the conventionally made web.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described ih such appended claims.

What is claimed is:

1. An abrasion resistant liquid absorbent base web comprising:

a stratified single fibrous web including a first outer fibrous layer defining a first side of said base web and a second and opposing outer fibrous layer defining a second side of said base web, said first and second outer layers containing synthetic staple fibers, said web containing synthetic fibers in an amount sufficient to increase the wet strength and abrasion resistance of said web;

an intermediate fibrous layer positioned between said first outer layer and said second outer layer, said intermediate layer comprising hardwood fibers or alpha pulp fibers;

a bonding material applied to each side of said base web, said bonding material being applied to each side according to a predetermined pattern; and wherein each side of said base web is creped after said bonding material has been applied.

2. A base web as defined in claim 1, wherein said synthetic stable fibers comprise fibers containing polyester, nylon, polypropylene, rayon, or mixtures thereof.

3. A base web as defined in claim 1, wherein said synthetic staple fibers have a length of at least 0.25 inches and have a denier of less than about 2.5.

4. A base web as defined in claim 1, wherein said synthetic staple fibers are present within said web in an amount up to about 50% by weight.

5. A base web as defined in claim 1, wherein said first and second outer layers further contain pulp fibers combined with said synthetic staple fibers.

6. A base web as defined in claim 1, wherein said synthetic staple fibers are present within said web in an amount from about 5% to about 15% by weight.

7. A base web as defined in claim 1, wherein said synthetic staple fibers comprise polyester fibers.

8. A base web as defined in claim 1, wherein said intermediate layer comprises hardwood fibers having a fiber length of less than about 2 millimeters.

9. A base web as defined in claim 1, wherein said bonding material comprises a cross-linked polymer.

10. A base web as defined in claim 1, wherein said intermediate layer comprises alpha pulp fibers.

11. An abrasion resistant liquid absorbent base web comprising:

a stratified single fibrous web including a first outer fibrous layer defining a first side of said base web and a second and opposing outer fibrous layer defining a second side of said base web, said first and second outer layers comprising a mixture of synthetic staple fibers and pulp fibers, said synthetic staple fibers containing a material selected from the group consisting of polyester, nylon, polypropylene, rayon and mixtures thereof, each of said first and second outer layers comprising from about 15% to about 40% by weight of said base web, said synthetic fibers being present in said web in an amount sufficient to increase the wet strength and abrasion resistance of said web;

an intermediate fibrous layer positioned between said first outer layer and said second outer layer, said intermediate layer comprising fibers having a length of less than about 2.0 mm and a coarseness of less than about 10;

a bonding material applied to each side of said base web, said bonding material being applied to each side according to a preselected pattern, said bonding material comprising a latex composition, said latex composition comprising a material selected from the group consisting of an acrylate, a vinyl acetate, a vinyl chloride, and a methacrylate; and wherein each side of said base web is creped after said bonding material has been applied.

12. A base web as defined in claim 11, wherein said synthetic staple fibers are present within said base web in an amount from about 5% to about 15% by weight.

13. A base web as defined in claim 11, wherein said fibers contained within said intermediate layer comprise eucalyptus fibers.

14. A base web as defined in claim 11, wherein said fibers contained within said intermediate layer comprise hardwood fibers.

15. A base web as defined in claim 11, wherein said fibers contained within said intermediate layer are added in an amount from about 10% to about 40% by weight of said base web.

16. A base web as defined in claim 11, wherein said fibers contained within said intermediate layer are added in an amount sufficient to create a pore size gradient between said intermediate layer and said first and second outer layers.

17. A method for producing a liquid absorbent base web comprising the steps of:

providing a single stratified fibrous web including a middle layer comprising hardwood fibers or alpha pulp fibers, a first outer layer comprising a mixture of pulp fibers and synthetic staple fibers, and a second outer layer also comprising a mixture of pulp fibers and synthetic staple fibers, said synthetic staple fibers comprising polyester fibers, polypropylene fibers or nylon fibers, said synthetic fibers being present in said web in an amount sufficient to increase the wet strength and the abrasion resistance of said web, said fibrous web having a first side and a second side;

applying a first bonding material to said first side of said web in a preselected pattern and adhering said first side of said web to a first creping surface, said first bonding material comprising a latex composition;

creping said first side of said web from said first creping surface;

applying a second bonding material to said second side of said web in a preselected pattern and adhering said second side of said web to a second creping surface; and creping said second side of said web from said second creping surface.

18. A method as defined in claim 17, wherein said middle layer comprises a mixture of pulp fibers and hardwood fibers, said hardwood fibers comprising eucalyptus fibers.

19. A method as defined in claim 17, wherein said first bonding material and said second bonding material are each applied to said base web in an amount up to about 10% by weight, said first and second bonding materials being applied to said base web in a pattern that covers from about 20% to about 50% of the surface area of said first and second sides of said base web respectively.

20. A wiping product comprising:

a single stratified base web including a first outer fibrous layer defining a first side of said base web and a second and opposing outer fibrous layer defining a second side of said base web, said first and second outer layers comprising a mixture of synthetic staple fibers and pulp fibers, said synthetic staple fibers comprising polyester fibers being present within said wiping product in an amount from about 5% to about 15% by weight, each of said first and second outer layers comprising from about 15% to about 40% of the weight of said base web;

an intermediate fibrous layer positioned between said first outer layer and said second outer layer, said intermediate layer comprising hardwood fibers or alpha pulp fibers, said hardwood fibers or alpha pulp fibers being present within said base web in an amount from about 10% to about 40% by weight;

a bonding material applied to said first side of said base web according to a first predetermined pattern and to said second side of said base web according to a second predetermined pattern, said bonding material comprising a latex composition; and wherein said first side and said second side of said base web are creped after said bonding material has been applied.

21. A wiping product as defined in claim 20, wherein said intermediate layer comprises hardwood fibers, said hardwood fibers comprising eucalyptus fibers.

22. A wiping product as defined in claim 21, wherein said intermediate layer further contains softwood fibers.

23. A base web as defined in claim 1, wherein said intermediate layer comprises eucalyptus fibers.

24. A base web as defined in claim 1, wherein said bonding material comprises an ethylene vinyl acetate copolymer.

25. A base web as defined in claim 11, wherein said fibers contained within said intermediate layer comprise alpha pulp fibers.

26. A base web as defined in claim 11, wherein said bonding material comprises a cross-linked polymer.

27. A base web as defined in claim 26, wherein said bonding material comprises an ethylene vinyl acetate copolymer.

28. A base web as defined in claim 11, wherein said fibers contained in said intermediate layer comprise birch fibers.

29. A wiping product as defined in claim 20, wherein said bonding material comprises a cross-linked ethylene vinyl acetate.

30. A wiping product as defined in claim 20, wherein said hardwood fibers or alpha pulp fibers contained within said intermediate layer have a length of less than about 2 millimeters.

31. A wiping product as defined in claim 30, wherein said hardwood fibers or alpha pulp fibers contained within said intermediate layer have a coarseness of less than about 10.

32. A wiping product comprising:

a stratified single fibrous base web including a first outer fibrous layer defining a first side of said base web and a second and opposing outer fibrous layer defining a second side of said base web, said first and second outer layers comprising a mixture of synthetic staple fibers and pulp fibers, said synthetic staple fibers containing a material selected from the group consisting of polyester, nylon, polypropylene, rayon and mixtures thereof, said synthetic fibers being present within said web in an amount sufficient to increase the wet strength and abrasion resistance of said web, each of said first and second outer layers comprising from about 15% to about 40% by weight of said base web;

an intermediate fibrous layer positioned between said first outer layer and said second outer layer, said intermediate layer comprising fibers having a length of less than about 2.0 mm and a coarseness of less than about 10;

a bonding material applied to each side of said base web, said bonding material being applied to each side according to a preselected pattern; and wherein each side of said base web is creped after said bonding material has been applied.

33. A wiping product as defined in claim 32, wherein said intermediate layer contains eucalyptus fibers.

* * * * *